US006018917A

United States Patent [19]

Leek

[11] Patent Number: 6,018,917

[45] Date of Patent: Feb. 1, 2000

[54] INSERTED HOLDOWN FOR SHEARWALLS

[75] Inventor: William F. Leek, Anaheim, Calif.

[73] Assignee: Simpson Strong-Tie Company, Inc., Pleasanton, Calif.

[21] Appl. No.: 08/890,416

[22] Filed: Jul. 9, 1997

[51] Int. Cl.[7] ..... E02D 27/00

[52] U.S. Cl. ..... 52/250; 52/259; 52/274; 52/293.1; 52/295; 156/92; 156/423; 403/378; 403/393

[58] Field of Search ..... 52/293.1, 295, 52/298, 699, 704, 707, 250, 259, 272, 274; 156/92, 349, 423, 433; 403/378, 379.1, 379.3, 393

[56] References Cited

U.S. PATENT DOCUMENTS

| | | |
|---|---|---|
| 125,189 | 4/1872 | Freeman et al. . |
| 341,796 | 5/1886 | Craine . |
| 725,770 | 4/1903 | Probasco . |
| 885,043 | 4/1908 | Hambay . |
| 887,217 | 5/1908 | Oliphant . |
| 1,335,617 | 3/1920 | Solomon . |
| 1,445,938 | 2/1923 | Farrington . |
| 1,606,697 | 11/1926 | Dean . |
| 2,135,389 | 11/1938 | Dempsey . |
| 2,753,962 | 7/1956 | McBerty . |
| 3,429,092 | 2/1969 | Perry et al. . |
| 3,869,836 | 3/1975 | Allen . |
| 4,199,908 | 4/1980 | Teeters . |
| 5,355,642 | 10/1994 | Palamarz . |
| 5,501,048 | 3/1996 | Nakanishi . |

*Primary Examiner*—Carl D. Friedman
*Assistant Examiner*—Kevin D. Wilkens
*Attorney, Agent, or Firm*—Charles R. Cypher; James R. Cypher

[57] ABSTRACT

A method for anchoring a specialized structural member having an internal cavity to a foundation to resist uplift forces imposed on the structural member. Structural members having interior cavities with external openings are anchored to foundations by way of an anchor member embedded in the foundation and received and enveloped by the internal cavity. The anchor member is connected to the structural member by a plurality of fasteners. The anchor member is formed to provide multiple point-to-point contact with the structural member.

23 Claims, 5 Drawing Sheets

INSERTED HOLDOWN FOR SHEARWALLS

BACKGROUND OF THE INVENTION

This invention relates to a method for anchoring a structural member to a foundation to resist uplift forces imposed on the structural member. Specifically, this invention relates to an improved method of anchoring structural members, having interior cavities, to foundations with an anchor member embedded in the foundation and received by the internal cavity, and fastened to the structural member by fasteners.

All structures must be designed to resist lateral forces. Lateral forces on buildings are typically produced by wind loading and seismic forces. The extensive damage caused to buildings by the January 1994 earthquake at Northridge, Calif has demonstrated that systems for resisting lateral forces must be improved.

Building components that resist lateral forces are called lateral force resisting systems. Lateral forces imposed on a structure can create moment forces. These moment forces, in turn, create uplift forces on certain structural members and compression forces on others. Typically, architects design structures to resist these moment forces at the structural member in tension by anchoring the member in tension to its foundation.

In general there are three types of lateral force resisting systems used in framed buildings. These lateral force resisting system are commonly referred to as shearwalls. The first type, rigid frames, resist lateral forces by bending in the frame members. The second type, trusses or braced frames, resist lateral forces by primarily carrying the resulting tension and compression forces in diagonal members or cross braces. The third type, diaphragms, are large, flat structural units that act like deep, thin beams with the structural panel or panels of the diaphragms acting as the "web" of the beam and the chords of the diaphragms acting like the "flanges" of the beam. It is thought that shear deformation is the significant action in diaphragms. In all three types of shearwall, the vertical structural members or chords will be anchored to the foundation to resist the resulting moment forces on the shearwall.

The present invention provides an improved method of anchoring structural members against tension or uplift forces. It is particularly designed for anchoring the chords or vertical end members of shearwalls where moment forces can be pronounced. One specific application for the improved holdown connection of the present invention is the side walls framing a garage opening in areas with high seismic activity. These walls are often called garage returns. Garage return shearwalls are typically narrow (being less than 2 feet wide), but tall (generally, they are over 7 feet high) to create an opening that can accommodate two cars. Often, they must provide the entire lateral force resistance for the wall, since the garage door opening provides none. With such narrow, tall shearwalls the moment forces imposed are significant and overturning and uplift is a common failure mode.

Under generally accepted construction methods, specific vertical structural members or chords of shearwalls are anchored against uplift forces with holdowns attached to anchor bolts or straps. In the case of holdowns, they attach to the side of the chords with heavy screws, nails or bolts. The holdowns receive bolts which are embedded in the foundation below. In the case of straps, they attach to the sides of the chords and are themselves embedded in the foundation. This system works well when the vertical structural members or chords of the shearwall are solid or do not otherwise allow the chord to be centered over the anchor member; however, there is often eccentric loading on the anchor bolt or strap.

New building materials such as hollow steel tubing and construction elements formed with interior cavities are becoming available which can benefit from the present invention by having their anchoring member inserted in their interior cavity to reduce or eliminate eccentric loading.

SUMMARY OF THE INVENTION

It is an object of the present invention to attach a structural member to a foundation in a manner that reduces eccentric loading on the anchor member making the connection.

A further object of this invention is to strengthen the structural member that is anchored against forces that would cause it to bend past its point of elasticity by forming the connection so that the structural member embraces the anchor member.

A further object of the present invention is to brace the structural member against lateral forces by forming the connection so that the structural member embraces the anchor member.

It is a further object of the present invention to create a connection between a structural member and its foundation that is easily and inexpensively formed.

DESCRIPTION OF THE PREFERRED EMBODIMENTS OF THE INVENTION

Figure 1:
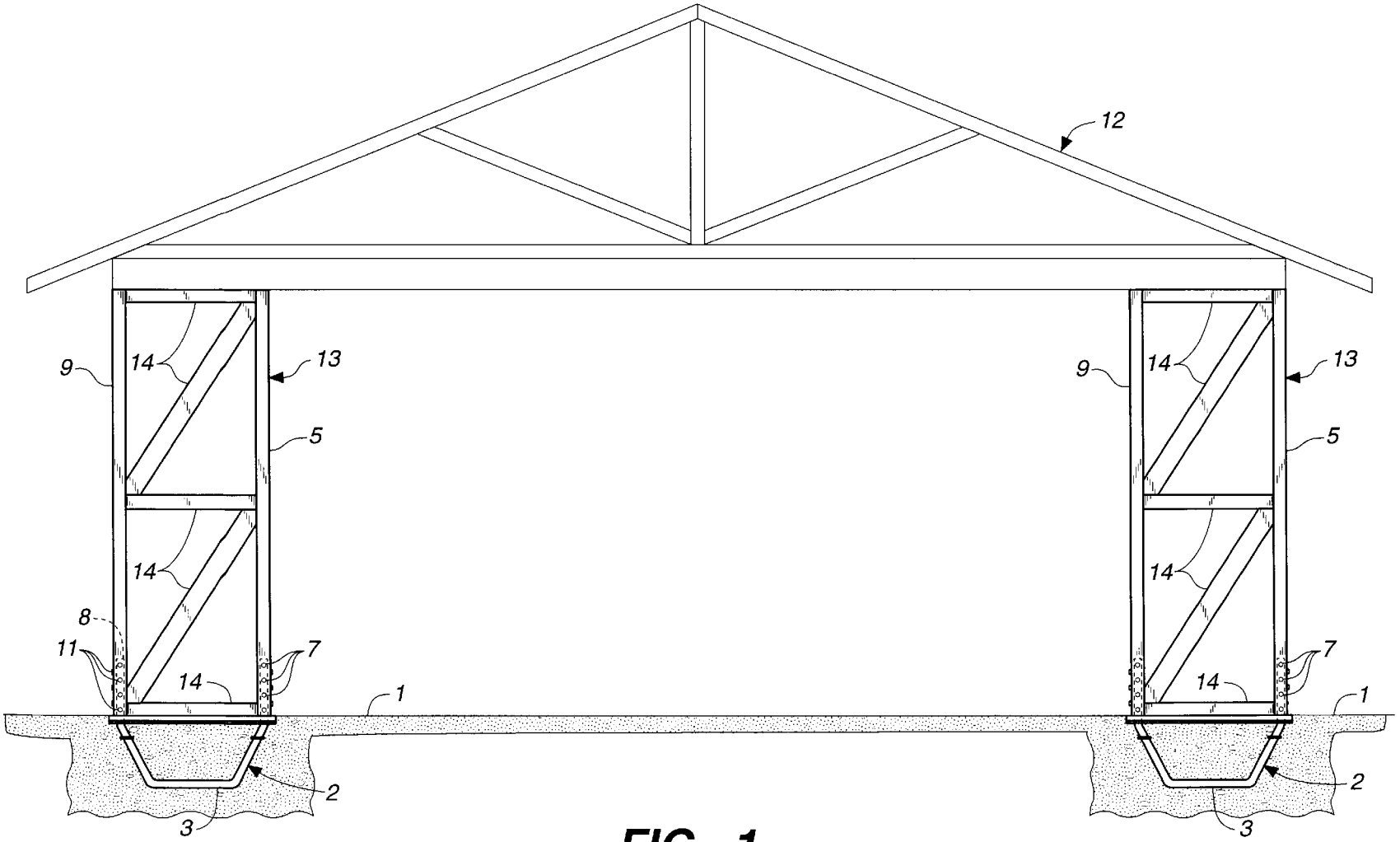
FIG. 1 is a front view of a structure having two braced-frame shearwalls anchored to its foundation according to the present invention. Portions of the foundation are omitted so as to reveal the anchor member embedded in the foundation. The particular anchor members shown are u-shaped and each have two anchor attachment ends for securing the two chords of the braced-frame shearwalls with one anchor member.
Figure 2:
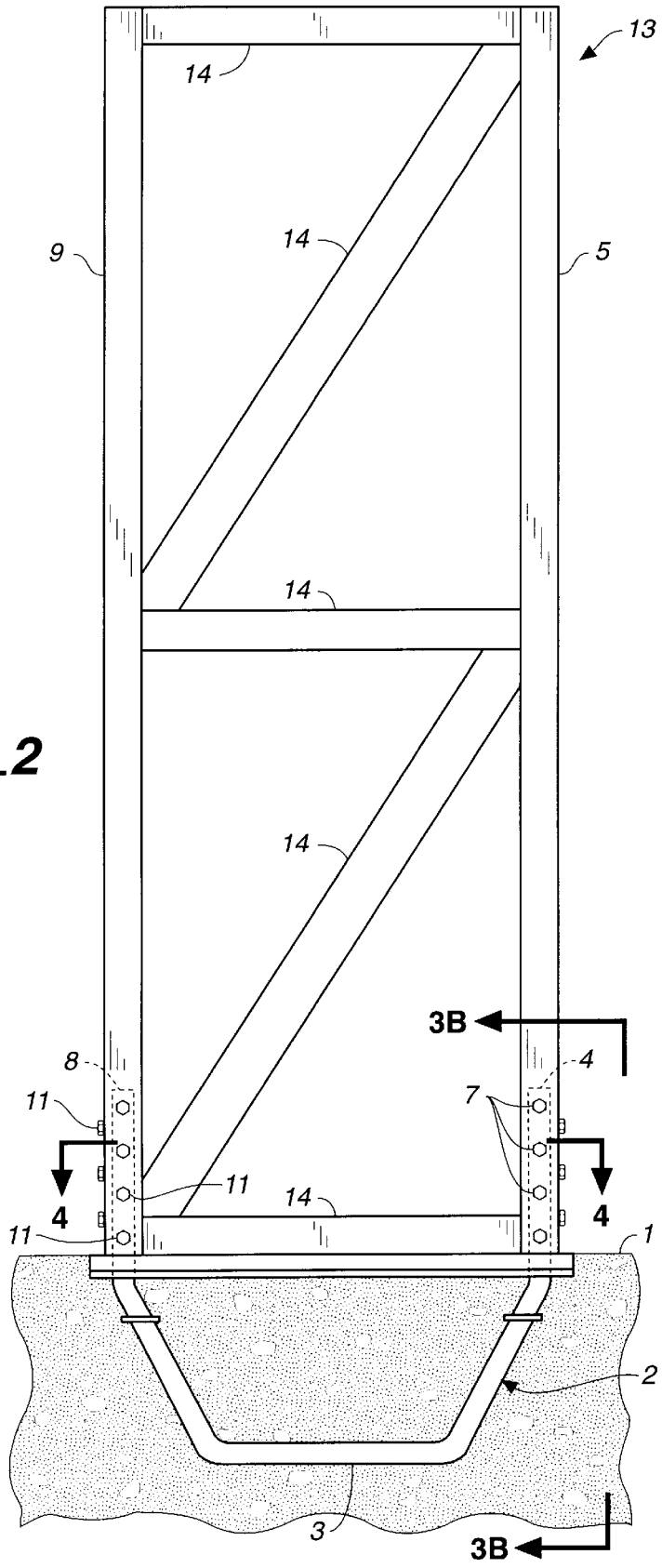
FIG. 2 is a front view of braced-frame shearwall anchored to a foundation according to the present invention. Portions of the foundation are omitted so as to reveal the anchor member embedded in the foundation. The particular anchor member shown is u-shaped and has two attachment anchor ends for securing the two chords of the braced-frame shearwall with one anchor member.

The present invention teaches a connection for securing a structural member to a foundation 1. As shown in FIG. 2, the connection of the present invention includes: an anchor member 2, having an embedment portion 3 disposed within and securely attached to the foundation 1 and a first anchor attachment end 4 protruding from the foundation 1; a first structural member 5 having an internal cavity 6 with an external opening, the internal cavity 6 receiving and enveloping the first anchor attachment end 4 such that the first anchor attachment end 4 contacts the first structural member 5 at a plurality of points; and a plurality of fasteners 7 connecting the anchor member 2 to the first structural member 5.

Figure 3A:
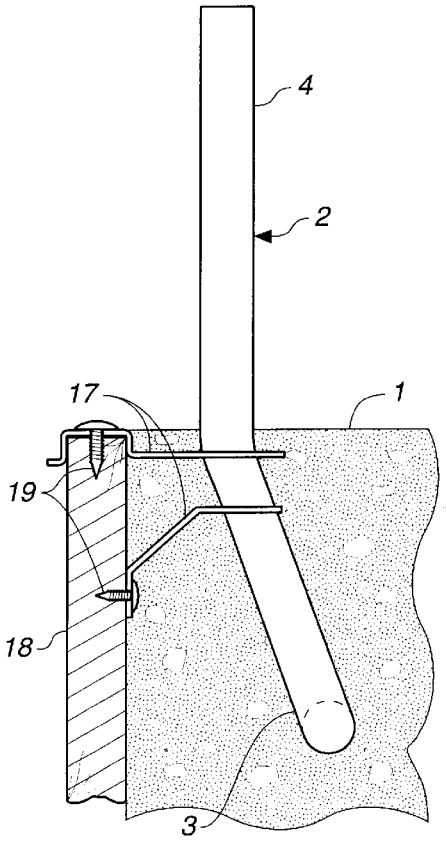
FIG. 3A is side view of an anchor member of the present invention shown embedded in a foundation. The anchor member is still attached by a jig to the form board used for forming the concrete foundation.

As shown in FIG. 3A the anchor member 2 is preferably set in the foundation 1 while the foundation 1 is poured. This allows a one-piece anchor member 2 with a bend or compound curve to be used, creating a strong mechanical interlock between the foundation 1 and the anchor member 2. Setting the anchor member 2 while the foundation 1 is being poured also prevents any space or gaps in the foundation 1 near the anchor member 2. Space between the anchor member 2 and the foundation 1 can allow water to reach the embedment portion 3 of the anchor member 2, where it can have a corrosive effect. Alternatively, the anchor member 2 can be set in the foundation 1 after the foundation 1 is cured. The preferred method for setting the anchor member 2 after the foundation 1 has cured is to drill a hole in the foundation 1 and set the anchor member 2 in epoxy poured into the hole. Epoxy makes a strong connection when properly used, but it is more time consuming than setting the anchor member 2 during the pouring of the foundation 1.

Preferably, the first anchor attachment end 4 is formed as a cylindrical, hollow member to allow the fasteners 7 to more easily penetrate the first anchor attachment end 4. See FIG. 4. In the preferred embodiment, the anchor member 2 is formed from steel. If such is the case, the preferred fasteners 7 for attaching the first anchor attachment end 4 to the first structural member 5 are metal screws that are self-tapping and self-drilling. Other fasteners 7 can be used such as pins, dowels, rivets or non-self-drilling screws, when holes are pre-drilled in the first structural member 5 and the first anchor attachment end 4. A plurality of fasteners 7 are used to create a strong connection. Furthermore, using a plurality of fasteners 7 allows readily available fasteners 7 to be used that do not have to be specifically designed for the present application.

The anchor member 2 is formed in accordance with the loading that will be placed on it and the dimensions of the first structural member 5 to which it will attach. Where the loading on the anchor member 2 will be high, as with tall, narrow shearwalls 13 the anchor member 2 can be made of a better grade and thicker gauge steel.

Figure 4:
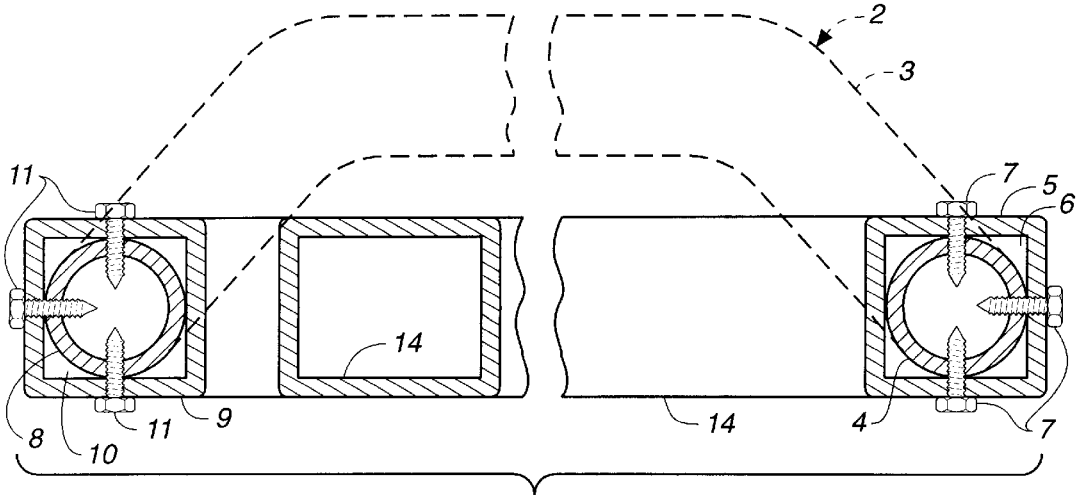
FIG. 4 is a cross-section of the braced-frame shearwall anchored to the foundation according to the present invention taken along line 4—4 of FIG. 2.

As shown in FIG. 4, the first anchor attachment end 4 is formed so that it provides multiple points of contact with the first structural member 5. The contact between the first anchor attachment end 4 and the first structural member 5 in combination with the enveloping of the first anchor attachment end 4 by the first structural member 5, such that the first structural member 5 completely encloses the first anchor attachment end 4, allows the anchor member 2 to provide bracing for the first structural member 5, giving it increased rigidity and strength, particularly in the plane of the shearwall 13. Shearwalls 13 are designed to resist loads in their plane. Chord members formed from steel have been known to fail by bending past their point of elasticity. This point-to-point bracing of the first structural member 5 by the anchor member 2 also allows the anchor member 2 to brace the first structural member 5 directly against the lateral force imposed on the first structural member 5 as well as the uplift force resulting from the moment force.

Figure 8:
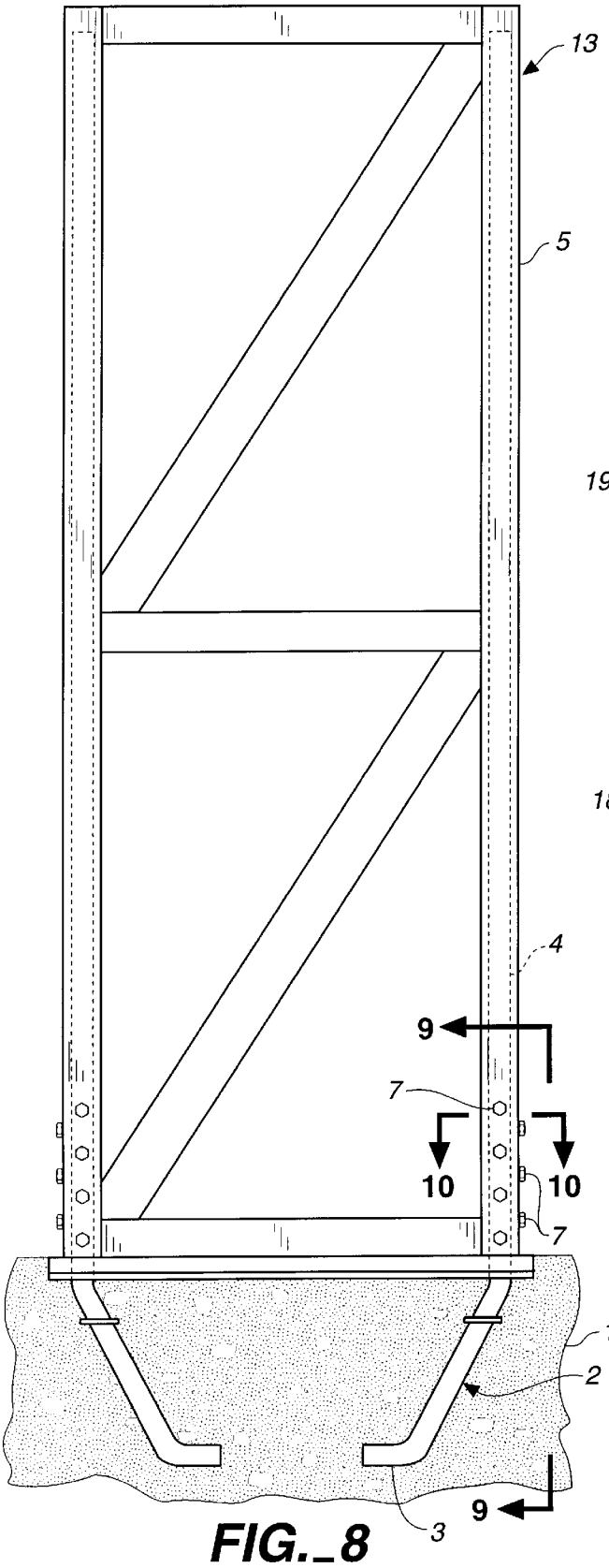
FIG. 8 is a front view of a braced-frame shearwall anchored according to the present invention. The anchor attachment end of the anchor member is shown in dashed lines and extends the length of the structural member to which it attaches. The braced-frame shearwall is anchored with two separate anchor members.
Figure 9:
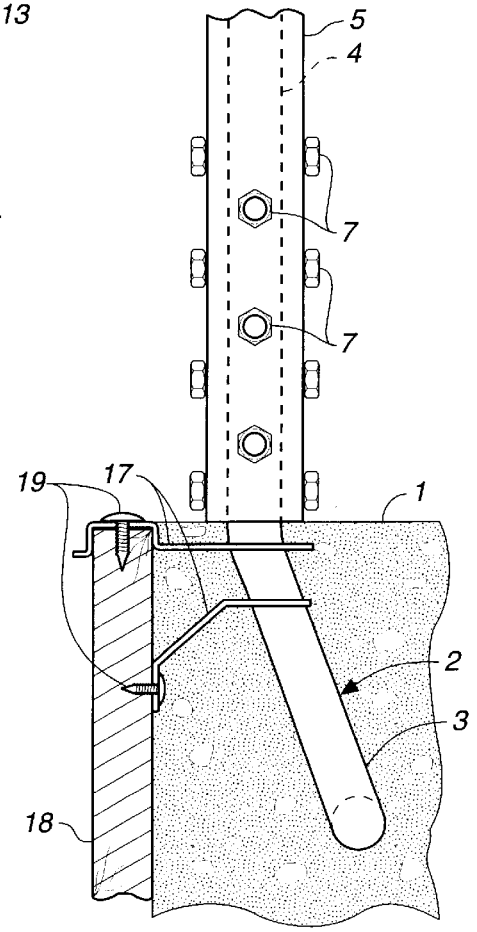
FIG. 9 is a side view of a portion of the brace-framed shearwall anchored according to the present invention taken along line 9—9 of FIG. 8.

Many new light-construction, framed-building structural members are being made of steel, such as studs, trusses and shearwalls 13. These members are often formed out of rolled sheet metal with hollow or interior cavities. Often the interior cavity will extend the length of the structural member. When the internal cavity 6 in the first structural member 5 extends the length of the first structural member 5, the first anchor attachment end 4 of the anchor member 2 can be formed to extend substantially half the length of the first structural member 5 to provide bracing to the first structural member 5 over substantially half of the length of the first structural member 5. See FIG. 5. Alternatively, when the internal cavity 6 in the first structural member 5 extends the length of the first structural member 5, the first anchor attachment end 4 of the anchor member 2 can be formed to extend substantially the length of the first structural member 5 to provide bracing to the first structural member 5 over the entire length of the first structural member 5. See FIG. 8. Forming the anchor member 2 with a long first anchor attachment end 4 can make installation more difficult, however, bracing may be necessary over a substantial length of the first structural member 5 when the first structural member 5 is made of lightweight materials.

As shown in FIGS. 2 and 4, in the preferred embodiment for anchoring shearwalls 13, the anchor member 2 can be formed as a substantially u-shaped member with a first anchor attachment end 4 and a second anchor attachment end 8. In forming the connection, the second anchor attachment end 8 protrudes from the foundation 1 and a second structural member 9, having an internal cavity 10 with an external opening is slipped over the second anchor attachment end 8. The second anchor attachment end 8 contacts the second structural member 9 at a plurality of points to provide bracing. A plurality of fasteners 11 are used to connect the second anchor attachment end 8 to the second structural member 9 to provide a connection that is strong and quickly made.

Preferably, the second anchor attachment end 8 is also formed as a hollow member to allow the fasteners 11 to penetrate the second anchor attachment end 8 more easily.

The second anchor attachment end 8, like the first anchor attachment end 4 can be made in an appropriate length to provide sufficient bracing to the second structural member 9.

Figure 5:
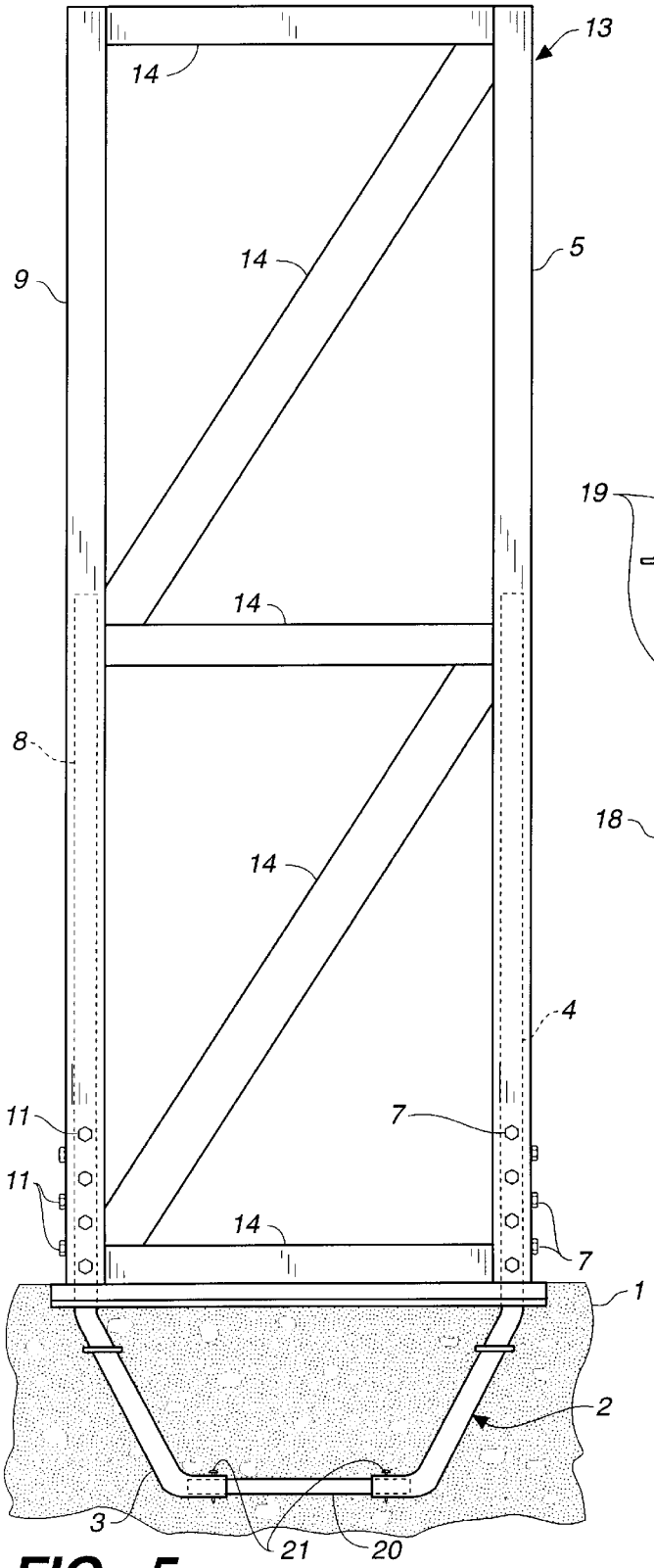
FIG. 5 is a front view of braced-frame shearwall anchored to a foundation according to the present invention. Portions of the foundation are omitted so as to reveal the anchor member embedded in the foundation. The attachment end of the anchor member is shown in dashed lines and extends approximately half the length of the structural member to which it attaches.

As shown in FIG. 5, in an alternate form of the present invention, the u-shaped anchor member 2 can be formed with an extension bar 20 for allowing adjustment of the distance between the first and second anchor attachment ends 4 and 8. The extension bar 20 can be formed with a plurality of openings and the embedment portion 3 of the anchor member 2 can be formed as a hollow member with corresponding openings. The embedment portion 3 of the anchor member 2 fits over the extension bar 20 and is secured to it with pins 21.

As mentioned earlier, the anchor member 2 of the present invention is particularly suitable for connecting a shearwall 13 to its foundation 1 to prevent uplift of the shearwall 13. In accordance with the description above and the drawings shown in the application, the first structural and second structural members 5 and 9 can be the chords of a wall element designed to resist lateral forces on a truss wall or braced-frame shearwall 13. As specifically shown in FIGS. 1, 2, 3B, 4, 5, 6, 7, 8, 9 and 10 the first and second structural members 5 and 9 are the chords of a braced-frame shearwall 13 designed to resist lateral forces on a structure 12, and the first and second structural members 5 and 9 are connected to each other by webbing members 14.

Figure 6:
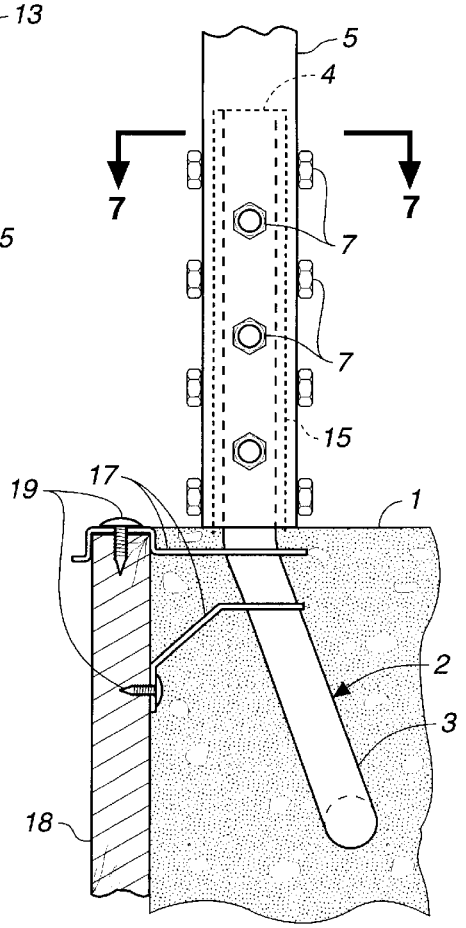
FIG. 6 is a side view of a portion of a braced-frame shearwall anchored according to the present invention. The attachment end of the anchor member is shown in dashed lines. A sleeve inserted over the anchor attachment end is also shown in dashed lines.
Figure 7:
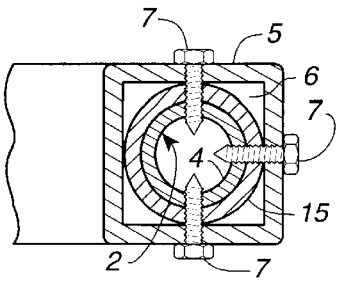
FIG. 7 is a sectional plan view of a portion of a braced-frame shearwall anchored according to the present invention taken generally along line 7—7 of FIG. 6.

As shown in FIGS. 6 and 7, in an alternate form of the invention, an element can be added when the first anchor attachment end 4 is too narrow to provide point-to-point contact with the first structural member 5.

Specifically, the connection is formed with an anchor member 2, having a embedment portion 3 disposed within and securely attached to the foundation 1 and a first anchor attachment end 4 protruding from the foundation 1; a sleeve 15 closely fitted over the first anchor attachment end 4 of the anchor member 2; a first structural member 5, having an internal cavity 6 with an external opening, the internal cavity 6 with the external opening receiving and enveloping the first anchor attachment end 4 of the anchor member 2 and the sleeve 15, the sleeve 15 dimensioned such that the sleeve 15 contacts the first structural member 5 at a plurality of points; and a plurality of fasteners 7 connecting the anchor member 2 to the first structural member 5.

Figure 10:
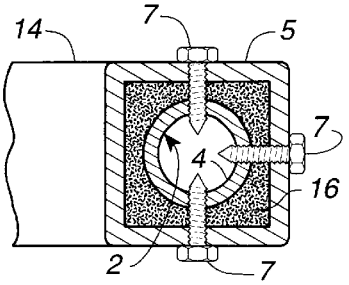
FIG. 10 is a sectional plan view taken along line 10—10 of FIG. 8 of a portion of a braced-frame shearwall anchored according to the present invention. An expandable adhesive is shown disposed between the structural: member and the anchor attachment end.

As shown in FIG. 10, in another form of the invention, epoxy or some other expandable adhesive 16, such as grout, can be used to fill the space between the first anchor attachment end 4 and the structural member 5 when the first anchor attachment end 4 is too narrow to provide bracing.

Specifically, the connection is formed with an anchor member 2, having a embedment portion 3 disposed within and securely attached to the foundation 1 and a first anchor attachment end 4 protruding from the foundation 1; a first structural member 5 having an internal cavity 6 with an external opening, the internal cavity 6 with an external opening receiving and enveloping the first anchor attachment end 4 of the anchor member 2; an expandable adhesive 16 disposed within the internal cavity 6, with the expandable adhesive 16 being substantially in contact with the first anchor attachment end 4 of the anchor member 2 and also substantially in contact with the portion of the first structural member 5 wherein the first anchor attachment end 4 of the anchor member is disposed, such that the first structural member 5 is closely held by the anchor member 2; and a plurality of fasteners 7 connecting the anchor member 2 to the first structural member 5.

The manner in which a sleeve 15 or an expandable adhesive 16 is used with a substantially u-shaped anchor member 2 formed with a second anchor attachment end 8 is similar and is thus not described in detail.

Figure 3B:
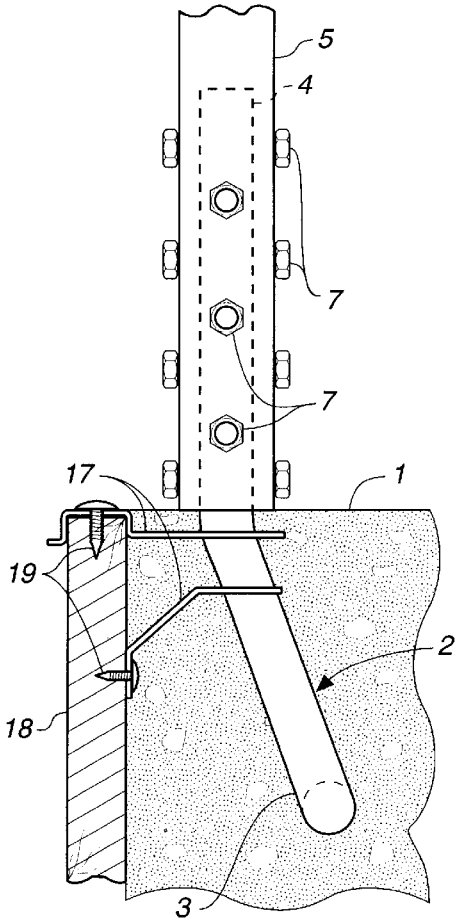
FIG. 3B is a side view of a portion of a braced-frame shearwall anchored according to the present invention taken generally along line 3B—3B of FIG. 2.

With reference to FIGS. 2 and 3B, preferably, a braced-frame shearwall 13 is connected to its foundation in the following manner, as is shown in FIG. 3B.

The form boards 18 for the foundation 1 for the structure 12 are erected to provide a form for pouring the concrete. Rebar is set into the form as needed. A jig 17 for holding the anchor member 2 is attached to the anchor member 2 and then attached to the form board 18 at the desired location. The jig 17 can be permanently attached to the anchor member 2, and temporarily fastened to the form board 18 with fasteners 19. Concrete is then poured into the form. The concrete forms and hardens around the embedment portion 3 of the anchor member 2, securing it in place. When the concrete foundation 1 has cured, the form boards 18 are stripped away, and exposed portions of the jig 17 for holding the anchor member 2 can be cut away or bent to sit flush with the foundation 1. The braced-frame shearwall 13 is then inserted over the first and second anchor attachment ends 4 and 8 of a single anchor member 2 as shown in FIG. 2. The internal cavities 6 and 10 of the first and second structural members 5 and 9 of the braced-frame shearwall 13 receive the first and second anchor attachment ends 4 and 8. Shims can be used to support the braced-frame shearwall 13, if necessary. In the preferred embodiment, the anchor member 2 and the first and second structural members 5 and 9 are formed from steel. If the steel of the first and second structural members 5 and 9 and the anchor member 2 is thin enough, self-drilling and self-tapping metal screws can be used as fasteners 7 and 11. Fasteners 7 are driven into the first structural member 5 and then into the first anchor attachment end 4 without having to pre-drill holes. Similarly, fasteners 11 are driven into the second structural member 9 and then into the second anchor attachment end 8. Sufficient fasteners 7 and 11 are used to achieve the desired uplift resistance values.

The invention is not limited to the specific form shown, but includes all forms within the definitions of the following claims.

I claim:

1. A connection for securing a structural member to a foundation, said connection comprising;

a. said foundation;

b. a bent, hollow, single-piece anchor member, having an embedment portion disposed within and securely attached to said foundation and a first anchor attachment end protruding from said foundation;

c. said structural member, said structural member having an internal cavity with an external opening, said internal cavity with said external opening receiving and enveloping said first anchor attachment end such that said first anchor attachment end contacts said first structural member at a plurality of points; and d. a plurality of fasteners connecting said anchor member to said structural member.

2. A connection for securing a structural member to a foundation, said connection comprising:

a. said foundation;

b. a bent, hollow, single-piece anchor member, having a embedment portion disposed within and securely attached to said foundation and a first anchor attachment end protruding from said foundation;

c. a sleeve closely fitted over said first anchor attachment end of said anchor member;

d. said structural member, said structural member having an internal cavity with an external opening, said internal cavity with said external opening receiving and enveloping said first anchor attachment end of said anchor member and said sleeve, said sleeve dimensioned such that said sleeve contacts said structural member at a plurality of points; and e. a plurality of fasteners connecting said anchor member to said structural member.

3. A connection for securing a structural member to a foundation, said connection comprising:

a. said foundation;

b. a bent, hollow, single-piece anchor member, having a embedment portion disposed within and securely attached to said foundation and a first anchor attachment end protruding from said foundation;

c. said structural member, said structural member having an internal cavity with an external opening, said internal cavity with said external opening receiving and enveloping said first anchor attachment end of said anchor member such that there is a portion of said structural member wherein said first anchor attachment end of said anchor member is disposed;

d. an expandable adhesive disposed within said internal cavity, with said expandable adhesive being substantially in contact with said first anchor attachment end of said first anchor member and also substantially in contact with said portion of said structural member wherein said first anchor attachment end of said anchor member is disposed, such that said structural member is closely held by said anchor member; and e. a plurality of fasteners connecting said anchor member to said structural member.

4. A connection for securing a discrete shearwall in a light-construction, framed building, said discrete shearwall having a first chord and a second chord connected by webbing members, to a foundation, said connection comprising:

a. said foundation;

b. an anchor member, having an embedment portion disposed within and securely attached to said foundation and a first anchor attachment end protruding from said foundation;

c. said first chord of said discrete shearwall in said light-construction, framed building, said discrete shearwall having said first and second chords connected by said webbing members, and said first chord having an internal cavity with an external opening, said internal cavity with said external opening receiving and enveloping said first anchor attachment end such that said first anchor attachment end contacts said first chord at a plurality of points; and d. a plurality of fasteners connecting said anchor member to said first chord.

5. The connection of claim wherein:

said anchor member is set in said foundation while said foundation is poured.

6. The connection of claim 4, wherein:

said first anchor attachment end is formed as a hollow member.

7. The connection of claim 4, wherein:

said anchor member is formed with a jig for attaching said anchor member to a foundation form board.

8. The connection of claim 4, wherein:

a. said internal cavity in said first chord extends the length of said first chord; and b. said first anchor attachment end of said anchor member extends substantially half the length of said first chord to provide bracing to said first chord over substantially half of the length of said first chord.

9. The connection of claim 4, wherein:

a. said internal cavity in said first chord extends the length of said first chord; and b. said first anchor attachment end of said anchor member extends substantially the length of said first chord to provide bracing to said first chord over the entire length of said first chord.

10. The connection of claim 4, further comprising:

a. an additional anchor member, having an embedment portion disposed within and securely attached to said foundation and a first anchor attachment end protruding from said foundation;

b. said second chord of said discrete shearwall in said light-construction, framed building, said second chord having an internal cavity with an external opening, said internal cavity with said external opening receiving and enveloping said first anchor attachment end of said additional anchor member, such that said first anchor attachment end of said additional anchor member contacts said second chord at a plurality of points; and c. a plurality of fasteners connecting said additional anchor member to said second chord.

11. A connection for securing a discrete shearwall in a light-construction, framed building, said discrete shearwall having a first chord and a second chord connected by webbing members, to a foundation, said connection comprising:

a. said foundation;

b. an anchor member, having an embedment portion disposed within and securely attached to said foundation and a first anchor attachment end protruding from said foundation;

c. a sleeve closely fitted over said first anchor attachment end of said anchor member;

d. said first chord of said discrete shearwall in said light-construction, framed building, said discrete shearwall having said first and second chords connected by said webbing members, and said first chord having an internal cavity with an external opening, said internal cavity with said external opening receiving and enveloping said first anchor attachment end of said anchor member and said sleeve, said sleeve dimensioned such that said sleeve contacts said first chord at a plurality of points; and e. a plurality of fasteners connecting said anchor member to said first chord.

12. The connection of claim 11, further comprising:

a. an additional anchor member, having an embedment portion disposed within and securely attached to said foundation and a first anchor attachment end protruding from said foundation;

b. an additional sleeve closely fitted over said first anchor attachment end of said additional anchor member;

c. said second chord of said discrete shearwall in said light-construction, framed building, said second chord having an internal cavity with an external opening, said internal cavity with said external opening receiving and enveloping said first anchor attachment end of said additional anchor member and said additional sleeve, said additional sleeve dimensioned such that said additional sleeve contacts said second chord at a plurality of points; and d. a plurality of fasteners connecting said additional anchor member to said second chord.

13. A connection for securing a discrete shearwall in a light-construction, framed building, said discrete shearwall having a first chord and a second chord connected by webbing members, to a foundation, said connection comprising:

a. said foundation;

b. an anchor member, having an embedment portion disposed within and securely attached to said foundation and a first anchor attachment end protruding from said foundation;

c. said first chord of said discrete shearwall in said light-construction, framed building, said discrete shearwall having said first and second chords connected by said webbing members, and said first chord having an internal cavity with an external opening, said internal cavity with said external opening receiving and enveloping said first anchor attachment end of said anchor member such that there is a portion of said first chord wherein said first anchor attachment end of said anchor member is disposed;

d. an expandable adhesive disposed within said internal cavity, with said expandable adhesive being substantially in contact with said first anchor attachment end of said anchor member and also substantially in contact with said portion of said first chord wherein said first anchor attachment end of said anchor member is disposed, such that said first chord is closely held by said anchor member; and e. a plurality of fasteners connecting said anchor member to said first chord.

14. The connection of claim 13, further comprising:

a. an additional anchor member, having an embedment portion disposed within and securely attached to said foundation and a first anchor attachment end protruding from said foundation;

b. said second chord of said discrete shearwall in said light-construction, framed building, said second chord having an internal cavity with an external opening, said internal cavity with said external opening receiving and enveloping said first anchor attachment end of said additional anchor member such that there is a portion of said second chord wherein said first anchor attachment end of said additional anchor member is disposed;

c. an expandable adhesive disposed within said internal cavity of said second chord, with said expandable adhesive being substantially in contact with said first anchor attachment end of said additional anchor member and also substantially in contact with said portion of said second chord wherein said first anchor attachment end of said additional anchor member is disposed, such that said second chord is closely held by said additional anchor member; and e. a plurality of fasteners connecting said additional anchor member to said second chord.

15. A connection for securing first and second structural members to a foundation, said connection comprising:

a. said foundation;

b. an anchor member, having an embedment portion disposed within and securely attached to said foundation and a first anchor attachment end protruding from said foundation;

c. said first structural member, said first structural member having an internal cavity with an external opening, said internal cavity with said external opening receiving and enveloping said first anchor attachment end such that said first anchor attachment end contacts said first structural member at a plurality of points;

d. a plurality of fasteners connecting said anchor member to said first structural member;

e. a second anchor attachment end, connected to said embedment portion of said anchor member, said second anchor attachment end protruding from said foundation;

f. said second structural member, said second structural member having an internal cavity with an external opening, said internal cavity with said external opening receiving and enveloping said second anchor attachment end such that said second anchor attachment end contacts said second structural member at a plurality of points; and g. a plurality of fasteners connecting said second anchor attachment end to said second structural member.

16. The connection of claim 15, wherein:

said second anchor attachment end is integrally connected to said embedment portion of said anchor member.

17. The connection of claim 15, wherein:

said second anchor attachment end is formed as a hollow member.

18. The connection of claim 15, wherein:

a. said internal cavities in said first and second structural members extend the length of said first and second structural members; and b. said first and second anchor attachment ends of said anchor member extend substantially half the length of said first and second structural members to provide bracing to said first and second structural members over substantially half of the length of said first and second structural members.

19. The connection of claim 15, wherein:

a. said internal cavities in said first and second structural members extend the length of said first and second structural members; and b. said first and second anchor attachment ends of said anchor member extend substantially the length of said first and second structural members to provide bracing to said first and second structural members over the entire length of said first and second structural members.

20. The connection of claim 15, wherein:

said first structural and second structural members are chords of a wall element designed to resist lateral forces on a structure.

21. The connection of claim 15, wherein:

said first structural and second structural members are chords of a truss wall designed to resist lateral forces on a structure, and said first and second structural members are connected to each other by a webbing member.

22. A connection for securing a pair of first and second structural members to a foundation, said connection comprising:

a. said foundation;

b. an anchor member, having a embedment portion disposed within and securely attached to said foundation and a first anchor attachment end protruding from said foundation:

c. a sleeve closely fitted over said first anchor attachment end of said anchor member;

d. said first structural member, said first structural member having an internal cavity with an external opening, said internal cavity with said external opening receiving and enveloping said first anchor attachment end of said anchor member and said sleeve, said sleeve dimensioned such that said sleeve contacts said first structural member at a plurality of points;

e. a plurality of fasteners connecting said anchor member to said first structural member;

f. a second anchor attachment end, connected to said embedment portion of said anchor member, said second anchor attachment end protruding from said foundation;

g. a second sleeve closely fitted over said second anchor attachment end of said anchor member;

h. said second structural member, said second structural member having an internal cavity with an external opening, said internal cavity with said external opening receiving and enveloping said second anchor attachment end of said anchor member and said second sleeve, said second sleeve dimensioned such that said second sleeve contacts said second structural member at a plurality of points; and i. a plurality of fasteners connecting said anchor member to said second structural member.

23. A connection for securing a pair of first and second structural members to a foundation, said connection comprising:

a. said foundation;

b. an anchor member, having a embedment portion disposed within and securely attached to said foundation and a first anchor attachment end protruding from said foundation;

c. said first structural member, said first structural member having an internal cavity with an external opening, said internal cavity with said external opening receiving and enveloping said first anchor attachment end of said anchor member such that there is a portion of said first structural member wherein said first anchor attachment end of said anchor member is disposed;

d. an expandable adhesive disposed within said internal cavity, with said expandable adhesive being substantially in contact with said first anchor attachment end of said first anchor member and also substantially in contact with said portion of said first structural member wherein said first anchor attachment end of said anchor member is disposed, such that said first structural member is closely held by said anchor member;

e. a plurality of fasteners connecting said anchor member to said first structural member;

f. a second anchor attachment end, connected to said embedment portion of said anchor member, said second anchor attachment end protruding from said foundation;

g. a second structural member having an internal cavity with an external opening, said internal cavity with said external opening receiving and enveloping said second anchor attachment end of said anchor member such that there is a portion of said second structural member wherein said second anchor attachment end of said anchor member is disposed;

h. an expandable adhesive disposed within said internal cavity of said second structural member, with said expandable adhesive being substantially in contact with said second anchor attachment end of said anchor member and also substantially in contact with said portion of said second structural member wherein said second anchor attachment end of said anchor member is disposed, such that said second structural member is closely held by said anchor member; and i. a plurality of fasteners connecting said anchor member to said second structural member.

* * * * *

UNITED STATES PATENT AND TRADEMARK OFFICE

CERTIFICATE OF CORRECTION

PATENT NO. : 6,018,917
DATED : February 1, 2000
INVENTOR(S) : William F. Leek

It is certified that error appears in the above-identified patent and that said Letters Patent is hereby corrected as shown below:

Column 7,
Line 53, replace "claim wherein" with -- claim 4 wherein --.

Signed and Sealed this

Twelfth Day of March, 2002

*Attest:*

*Attesting Officer*

JAMES E. ROGAN
*Director of the United States Patent and Trademark Office*